US006729930B1

(12) United States Patent
Lui

(10) Patent No.: US 6,729,930 B1
(45) Date of Patent: May 4, 2004

(54) BOBBLING HEAD FIGURE MAGNET

(76) Inventor: Hoe King Lui, 21/F, Mirage Tower, No. 15 Thomson Road, Wanchai (HK)

( * ) Notice: Subject to any disclaimer, the term of this patent is extended or adjusted under 35 U.S.C. 154(b) by 0 days.

(21) Appl. No.: 10/459,773

(22) Filed: Jun. 12, 2003

(51) Int. Cl.[7] ..... A63H 33/26

(52) U.S. Cl. ..... 446/139; 446/100; 446/391; 446/486; 40/411

(58) Field of Search ..... 446/97, 99, 100, 446/321, 330, 351, 337, 338, 376, 379, 380, 391, 486, 137, 139; 434/393; 40/411, 424, 765–767

(56) References Cited

U.S. PATENT DOCUMENTS

| | | | | |
|---|---|---|---|---|
| 2,199,049 A | | 4/1940 | Greenberg | |
| 2,243,912 A | | 6/1941 | Legler | |
| D138,777 S | | 9/1944 | Lecois | |
| 2,484,343 A | | 10/1949 | Hawes | |
| D161,962 S | | 2/1951 | Plante | |
| 2,760,303 A | | 8/1956 | Del Mas | |
| 2,775,064 A | * | 12/1956 | Otto | 446/139 |
| D181,009 S | | 9/1957 | Lakin | |
| 2,848,236 A | * | 8/1958 | Gibson, Jr. | 473/576 |
| 3,526,991 A | | 9/1970 | Goldfarb | |
| 3,703,292 A | * | 11/1972 | Starr | 273/330 |
| D226,772 S | | 4/1973 | Ehrenreich | |
| 3,863,386 A | | 2/1975 | Kinberg | |
| 4,020,586 A | | 5/1977 | Benner | |
| D266,273 S | | 9/1982 | Bass | |
| D294,843 S | | 3/1988 | Lund | |
| D316,404 S | | 4/1991 | Calleja | |
| 5,050,834 A | | 9/1991 | Tardiff | |
| 5,141,466 A | | 8/1992 | Catizone | |
| D330,509 S | | 10/1992 | Belknap | |
| 5,266,920 A | | 11/1993 | Langner | |
| 5,403,224 A | | 4/1995 | Gintling | |
| 5,784,817 A | | 7/1998 | Behme | |
| 5,803,788 A | | 9/1998 | Penberthy et al. | |
| D413,152 S | | 8/1999 | Chow | |
| 5,947,791 A | | 9/1999 | Taylor | |
| D419,309 S | | 1/2000 | Leon | |
| D421,034 S | | 2/2000 | Shirley et al. | |
| 6,129,606 A | | 10/2000 | Yuen | |
| 6,183,338 B1 | | 2/2001 | Mallette | |
| D466,565 S | | 12/2002 | Borgaro et al. | |
| 6,511,359 B1 | | 1/2003 | Lui | |
| 6,533,634 B1 | * | 3/2003 | Sugar | 446/72 |

* cited by examiner

*Primary Examiner*—H. Derris Banks
*Assistant Examiner*—Bena Miller
(74) *Attorney, Agent, or Firm*—Jack C. Munro

(57) ABSTRACT

A magnet which has a base which is substantially flat the exterior surface of which is formed into a figure representation. The head of the figure is attached by a single, thin member to the base with the head of the figure including a photo receiving slot.

6 Claims, 2 Drawing Sheets

BOBBLING HEAD FIGURE MAGNET

BACKGROUND OF THE INVENTION

1. Field of the Invention

The subject matter of this invention relates to magnets and more particularly to a sheet magnet the exterior surface of which is formed into a toy figure representation and which includes a bobbling head with the bobbling head including a photo receiving compartment with a photographic likeness of a person to be located within the photo receiving compartment.

2. Description of the Related Art

Toy figurines have long appealed to children and adults. Toy figurines, or dolls, are commonly used by female children to play with. Besides the constructing of dolls, toy figurines can be made in numerous forms. One form is to design the toy figurine as a figure representation in conjunction with a sheet magnet. Sheet magnets are in common use as an ornament and as a holder for paper notes and pictures. Sheet magnets are commonly placed on refrigerators. However, sheet magnets can also be placed in conjunction with any metallic cabinet, not just a refrigerator. The normal function for such a sheet magnet is to hold a paper note in a prominently displayed position which usually functions as a reminder to the human user. The human user is usually reminded of a date or an occurrence of a particular situation, such as a birthday, a party, etc., It has been known to construct these sheet magnets in one basic form and that is with the exterior surface of the sheet magnet including some ornamentation, such as a figure design. A relatively new type of figurine is one which mounts the head of the figurine on the body in a manner so that the head can move. It is common to connect the head by means of a thin, single member, such as a spring, relative to the body. This will permit the head to move randomly in a limited amount in a multitude of directions. This type of movement is frequently termed bobbling.

It is also known to construct a doll or toy figurine that contains a photographic representation of a human being within the face of the toy figurine. Thus, a particular person may find pleasure in having a representation of himself or herself, girlfriend or boyfriend, another sibling or an adult, such as a father, mother, aunt or uncle mounted in conjunction with a toy figurine. Prior to the present invention, it has not been known to utilize the bobbling head structure in conjunction with a magnet that is to be placed on a metallic cabinet.

SUMMARY OF THE INVENTION

The basic embodiment of the present invention utilizes a sheet material magnet that has an exterior surface that is designed into a figure representation. The representation is to include a head. This head is mounted by a thin, single member relative to the base of the magnet with the head being spaced a short distance from the base. The head is capable of random bobbling movement relative to this base.

A further embodiment of the present invention is where the basic embodiment is modified by the head being substantially smaller in size than the base.

A further embodiment of the present invention is where the basic embodiment is modified by the thin, single member comprising a coil spring.

A further embodiment of the present invention is where the basic embodiment is modified by the head including a photo receiving compartment with part of a photograph capable of being formed to fit the compartment and be slipped in conjunction with the compartment thereby individualizing the figure of the base to, correspond to a particular known individual.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
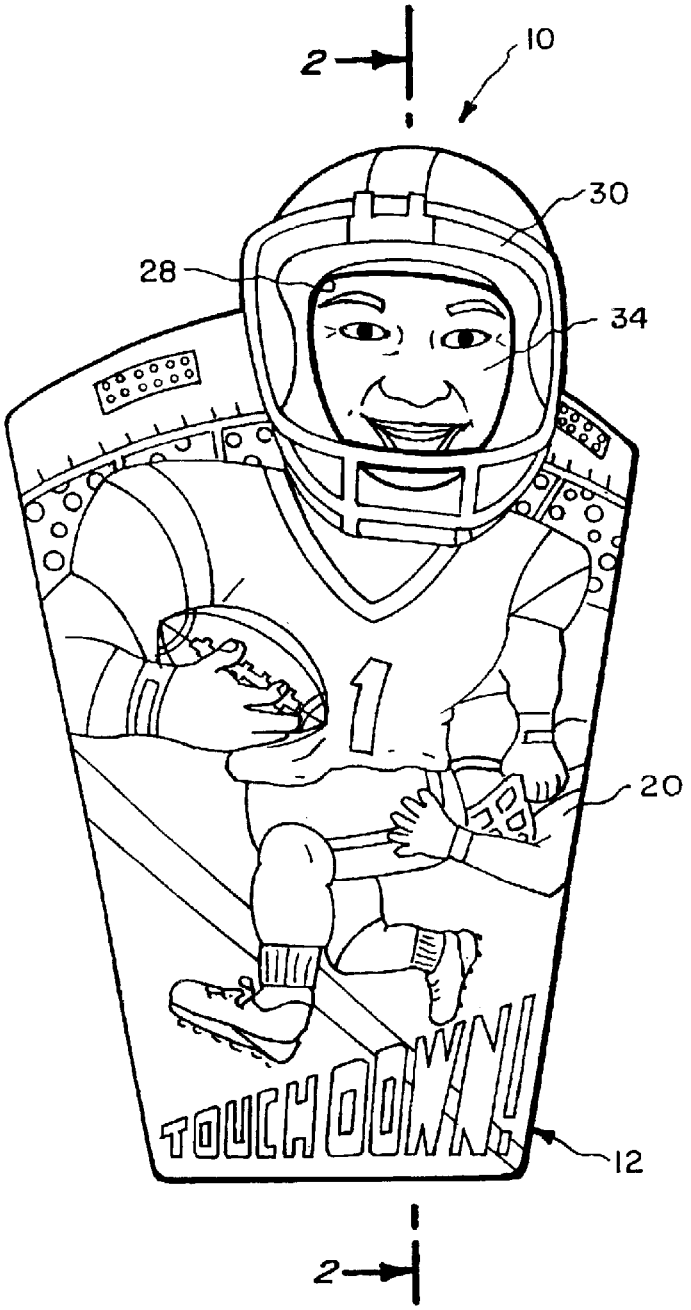
FIG. 1 is a frontal elevational view of the magnet constructed in accordance with this invention.
Figure 2:
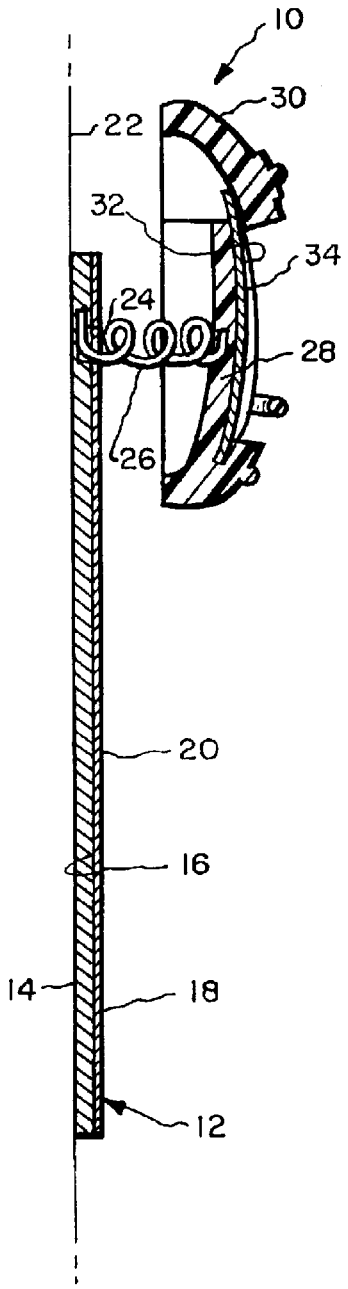
FIG. 2 is a longitudinal cross-sectional view taken along line 2—2 of FIG. 1.
Figure 3:
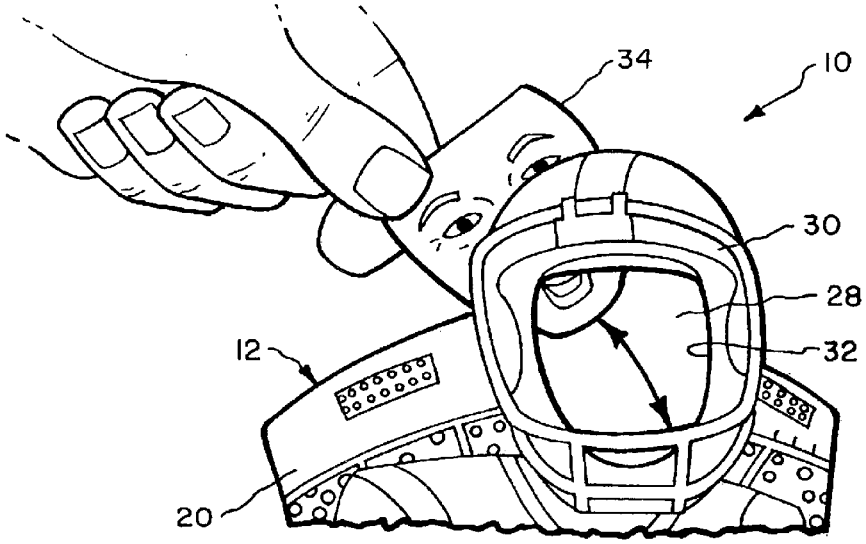
FIG. 3 is a view of the head portion of the magnet showing the connection in conjunction with part of a photograph.

Referring particularly to the drawings, there is shown in FIGS. 1–3 the first embodiment 10 of bobbling head figure magnet of this invention. The bobbling head figure magnet comprises a base 12 which is basically flat and is formed thin and is slightly bendable. The base 12 includes a sheet magnet 14 attached to an interior surface 16 of a covering 18. The covering 18 has an exterior surface 20. The exterior surface 20 of the covering 18 is to include a figure representation which in FIGS. 1–3 is shown to be that of a football player. Also, the exterior surface 20 can include numerical indicia as well as writing indicia. The sheet magnet 14 is deemed to be conventional with such magnets being in common use. The intent and purpose of the base 12 is to be mounted against a metallic cabinet 22, such as a refrigerator. The sheet magnet 14 can be used to hold onto a picture or a note and display such prominently to function as a reminder to the user of a date or a certain occurrence.

Fixedly mounted to the sheet magnet 14 and extending through a hole 24 formed in the covering 18 is a thin, single member in the form of a coil spring 26. Although the use of a coil spring is preferred, it is considered to be within the scope of this invention that the single, thin member could comprise a device other than a coil spring, such as a thin strip of metal.

The outer end of the coil spring 26 is fixedly mounted to a plate 28. The plate 28 is formed part of a border 30. The border 30 cooperates with the plate 28 to form therebetween a compartment 32. The border 30 can be formed into any desired shape, such as in FIG. 3 where it is formed into the shape of a football helmet. A photographic section 34, which is usually a piece of paper, is cut to be formed to just fit the size of the compartment 22. The photographic section 34 is then slipped through the inlet opening 36 into the compartment 32 to thereby be displayed in conjunction with the head which is formed by the plate 28 and the border 30. This head is free to randomly move on the coil spring 26 relative to the base 12 to give the appearance of movement of the figure that is represented by the photographic section 34 and the figure representation on the exterior surface. 20 of the base 12.

Figure 4:
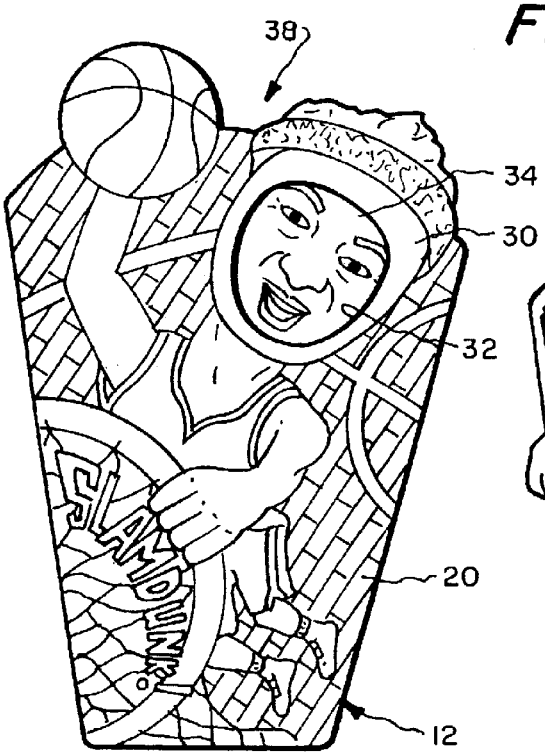
FIG. 4 is a view similar to FIG. 1 but showing a different type of figure representation than that of FIG. 1.

Referring particularly to FIG. 4, there is shown a second embodiment 38 of this invention. Like numerals have been employed to refer to like parts. The only difference between FIG. 4 relative to FIG. 1 is that the figure representation is that of a basketball player rather than the football player of FIG. 1.

Figure 5:
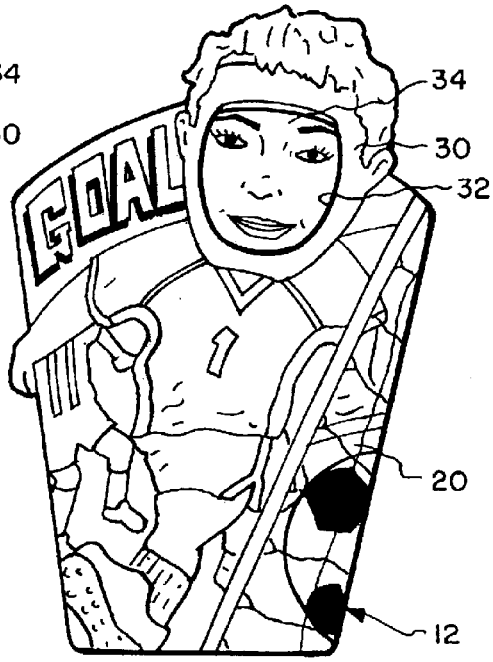
FIG. 5 is a view similar to FIG. 4 but showing a further different type of figure representation.

Referring particularly to FIG. 5, there is shown a third embodiment 40 of this invention. Again, like numerals have been employed to refer to like parts. The only difference between the third embodiment 40 relative to the first embodiment 10 and the second embodiment 38 is that the third embodiment comprises a representation of a soccer player.

It is considered to be within the scope of this invention that the bobbling head figure magnet of this invention could be constructed in any desired figure representation and, in fact, the head, though normally the representation of a head of a figure, may not even comprise a representation of a head of a figure.

What is claimed is:

1. A bobbling head figure magnet comprising:

a base, said base being substantially flat, said base having a flat interior surface and a flat exterior surface, said interior surface having a sheet magnet fixedly attached thereto, said exterior surface including a figure representation; and said figure representation including a head, said head being mounted by a thin, single member to said base and spaced from said base, said head capable of random bobbling movement relative to said base.

2. The bobbling head figure magnet as defined in claim 1 wherein:

said head being substantially smaller in size than said base.

3. The bobbling head figure magnet as defined in claim 1 wherein:

said thin, single member comprising a coil spring.

4. The bobbling head, figure magnet as defined in claim 1 wherein:

said figure representation covering entirely said flat exterior surface.

5. A bobbling head figure magnet comprising:

a base, said base being substantially flat, said base having an interior surface and an exterior surface, said interior surface having a sheet magnet attached thereto, said exterior surface including a figure representation;

said figure representation including a head, said head being mounted by a thin, single member to said base and spaced from said base, said head capable of random bobbling movement relative to said base: and said head includes a photo receiving compartment with an entry slot connecting with said compartment, whereby a photograph is adapted to be inserted through said entry slot into said photo receiving compartment.

6. The bobbling head figure magnet as defined in claim 5 wherein:

said flat interior surface being parallel to said flat exterior surface.

* * * * *